US005307944A

United States Patent [19]

Reedy

[11] Patent Number: 5,307,944

[45] Date of Patent: May 3, 1994

[54] SKI EQUIPMENT SUPPORT RACK

[75] Inventor: Michael H. Reedy, Edwardsville, Ill.

[73] Assignee: Lee Rowan Company, St. Louis, Mo.

[21] Appl. No.: 994,202

[22] Filed: Dec. 21, 1992

[51] Int. Cl.[5] ..... A47F 7/00

[52] U.S. Cl. ..... 211/70.5; 211/106; D6/552

[58] Field of Search ..... 211/106, 70.5, 87; D6/552

[56] References Cited

U.S. PATENT DOCUMENTS

| | | | |
|---|---|---|---|
| D. 299,100 | 12/1988 | Martinell et al. . | |
| 1,667,264 | 4/1928 | Minnick | 211/106 X |
| 1,891,310 | 12/1932 | Hicks | 211/106 |
| 2,919,032 | 12/1959 | Sinawski | 211/70.5 |
| 2,956,812 | 10/1960 | Lundquist | 211/70.5 X |
| 3,421,725 | 1/1969 | Glass | 211/70.5 X |
| 3,685,667 | 8/1972 | Bell | 211/70.5 |
| 4,050,706 | 9/1977 | Kronstadt . | |
| 4,271,997 | 6/1981 | Michael . | |

FOREIGN PATENT DOCUMENTS

| | | | |
|---|---|---|---|
| 3326300 | 1/1985 | Fed. Rep. of Germany | 211/70.5 |

*Primary Examiner*—Robert W. Gibson, Jr.
*Attorney, Agent, or Firm*—Rogers, Howell & Haferkamp

[57] ABSTRACT

A ski equipment support rack for mounting to a wall and for removably and uprightly supporting skis, ski poles, and other accessories of the sport. This ski equipment support rack comprises bent metal wire elements fixed together in relative positions by welded joints. For supporting two skis urged together to have mutually adjacent bottom surfaces, the ski equipment support rack has structure defining a slot extending in the lateral direction. On either side of the slot, the ski equipment support rack has wire segments on which the oppositely extending bindings of the two skis can be removably supported.

18 Claims, 1 Drawing Sheet

SKI EQUIPMENT SUPPORT RACK

BACKGROUND AND SUMMARY OF THE INVENTION

The present invention relates to a ski equipment support rack and more particularly to a ski equipment support rack for mounting to a wall and for removably and uprightly supporting skis and ski poles.

Ski storage racks for removably and uprightly supporting skis are known in the art. A known rack, shown in U.S. Pat. No. 299,100, comprises a mounting plate for mounting to a wall and a pair of loops of bent rod projecting forward from the mounting plate. The loops are laterally spaced apart to receive an upright ski between them.

The ski equipment support rack of the present invention is an improvement over the ski storage racks of the prior art. A first advantage of this support rack is that a pair of skis are supported with their bottom surfaces in mutual contact with the bindings of the two skis extending outwardly in opposite directions for resting on the support segments of the rack. Thus, the skis are firmly supported without any contact with the bottom surface of the skis, avoiding risk of any damage to those bottom surfaces.

A second advantage of the ski equipment support rack is the safer manner by which it supports skis. The ski equipment support rack has wire segments defining a slot that opens to a side rather than to the front. As a result, if the removably supported skis should shift or fall off the ski rack, the skis would accordingly shift or fall laterally rather than forwardly, thereby minimizing the risk of injury.

In addition, this ski equipment support rack comprises a fixed frame of relatively inexpensive metal wire elements welded together and coated in enamel. The individual wire elements are bent into configurations that provide gains in manufacturing simplicity and efficiency. The ski equipment support rack is the strong, yet inexpensive to fabricate. The ski equipment rack is also lightweight, which further results in reduced shipping costs. These and more advantages are provided by the present invention without sacrificing appearance or durability.

In accordance with the present invention, a ski equipment support rack is made of bent metal wire elements held together in relative positions by welded joints. The ski equipment support rack has parallel wire segments that define a slot that opens laterally rather than forwardly. Two skis to be supported are oriented with their bottom surfaces in mutual contact and their bindings projecting outwardly. The parallel wire segments on either side of the slot underlie the opposed bindings to removably support the skis.

In addition, the ski equipment support rack has wire retainer segments above the support segments to restrict the forward rotation of the skis about the support wires. Still further, the ski equipment support rack has other wire segments which define slots for removably receiving ski poles.

For making this ski equipment support rack of smaller gauge wire than otherwise possible, long segments of wires are supported by other wires. Because the supporting wires are anchored and are inclined, the long segments of wires are well supported and can be of reduced gauge wire.

For supporting two pairs of skis, both the forward and the rearward ski-supporting wires have mirror opposite left and right segments. Each resulting left and right slot can removably receive two generally upright skis that have mutually adjacent bottom sides. The parallel wires on the forward and rearward sides of either the left or right slot support the skis by their bindings.

For manufacturing efficiency and simplicity, the left and right rearward two segments of wire for supporting the ski bindings are part of a single bent wire. For the same purposes, the left and right forward two segments of wire for supporting the ski bindings are part of another single bent wire. All welds are in a common plane.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
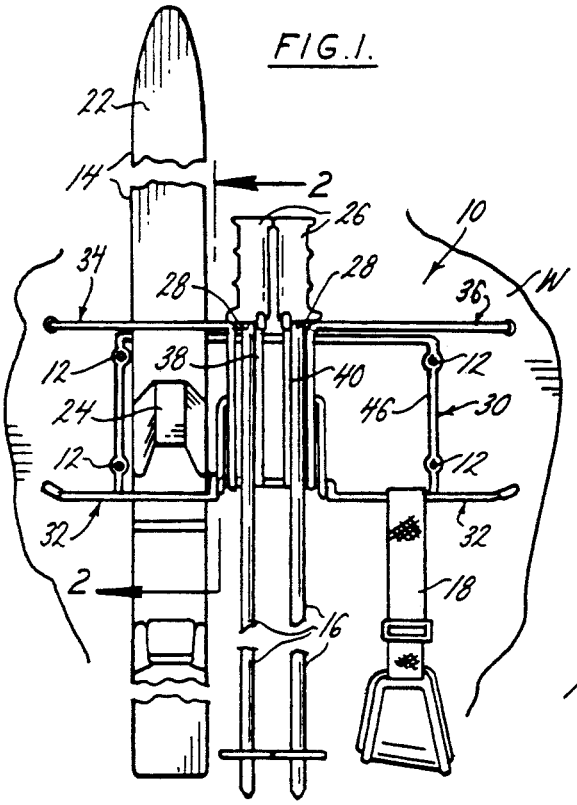
FIG. 1 is front elevation view of the ski equipment support rack of the present invention, shown mounted to a wall and removably supporting representative skis and ski poles as well as a representative pair of goggles.

As shown by FIG. 1, a ski equipment support rack 10 is provided for attaching to a front of a wall W by means of screw fasteners 12, and for removably and uprightly supporting skis 14 and ski poles 16, as well other accessories of the sport such as goggles 18. The two skis 14 have mutually adjacent bottom surfaces 20, oppositely facing top surfaces 22, and bindings 24 affixed to the top surfaces 22 extending oppositely. The ski poles 16 have hand-grip portions 26 defining annular bottom surfaces 28.

With general reference to the Figures, this ski equipment support rack 10 essentially consists of six metal wire elements, welded together and bent as more particularly described below. In general, though, those six wire elements include both a wire hoop 30 (generally though not perfectly a hoop) for attachment to the wall W and an interlinking wire 32 which is generally horizontally planar. Those six wire elements further include a pair of opposite tridirectional wires 34 and 36, which have three distinct segments extending along three axes (up to down, front to back, left to right). And still further, there is a pair of inverted-L shaped wires 38 and 40.

The hoop 30 has a centrally disposed planar back portion 46 and a pair of opposite forwardly projecting loop portions 48 and 50 on either side of the back portion 46. The planar back portion 46 is formed of a central horizontal wire segment 52 extending between opposite downward bends 54 and 56 that lead to left and right vertical segments 58 and 60. There are forwardly turned bends 62 and 64 at the lower ends of the vertical segments 58 and 60.

The left and right loop portions 48 and 50 have distal brace segments 72 and 74 that are joined to the lower bends 62 and 64 of the planar back portion 46. The distal brace segment 72 and 74 diverge from one another as they extend in a horizontal plane from the lower bends 62 and 64 to outer forward bends 76 and 78. The loop portions 48 and 50 further comprise horizontal support segments 82 and 84 that are joined to the outer forward bends 76 and 78 and extend inwardly to inner forward bends 86 and 88. The loop portions 48 and 50 further comprise proximal brace segments 90 and 92 that are joined to the inner forward bends 86 and 88 and extend at upward inclines to inner rearward bends 96 and 98. Finally, the loop portions 48 and 50 comprise opposite stub segments 100 and 102 that are joined to the inner rearward bends 96 and 98 and extend inwardly to terminal ends 104 and 106, which are spaced from one another by a lateral gap as shown.

To turn to the interlinking wire 32, it comprises a centrally disposed segment 110 that extends horizontally left to right. The centrally disposed segment 110 terminates in opposite bends 112 and 114. The interlinking wire further comprises opposite brace segments 116 and 118 that are joined to the opposite bends 112 and 114 and from there slightly decline to forward bends 120 and 122. The interlinking wire 32 further comprises opposite support segments 126 and 128 that are joined to the forward bends 120 and 122 and extend outwardly to opposite terminal ends 130 and 132.

The opposite support segments 126 and 128 of the interlinking wire 32 have bending portions 134 and 136 that are spaced just inwardly from their respective terminal ends 130 and 132. These bending portions 134 and 136 thereby provide the opposite support segments 126 and 128 with upwardly turned sloping sections 140 and 142. As a safeguard, the terminal ends 130 and 132 are covered with resilient caps 144 and 146 to cover metal burrs and the like.

Figure 3:
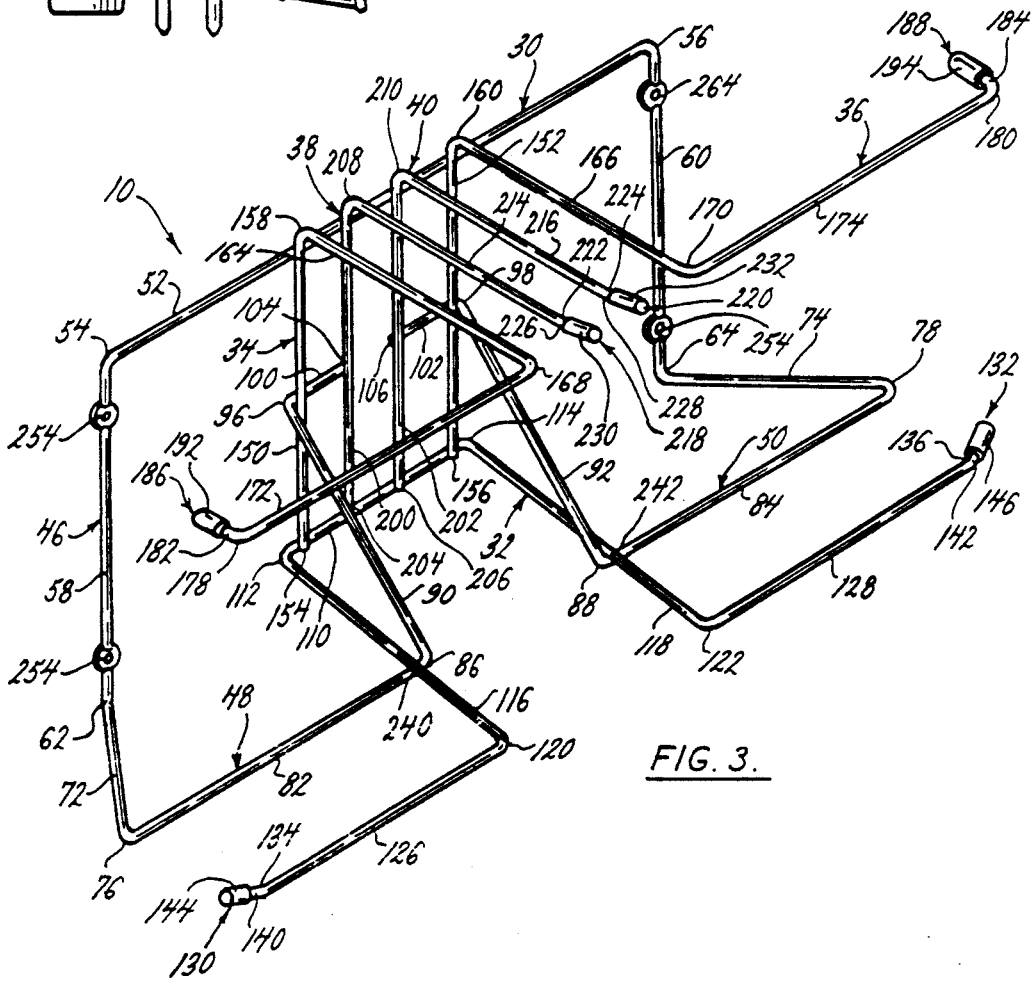
FIG. 3 is a perspective view of the ski equipment support rack of the present invention.

The tridirectional wires 34 and 36 comprise vertical segments 150 and 152 that have lower terminal ends 154 and 156. The vertical segments 150 and 152 extend upwardly from the lower terminal ends 154 and 156 to upper bends 158 and 160, which are bent forwardly. The vertical segments 150 and 152 extend across and are welded to the centrally disposed segment 52 of the wire hoop 30, the centrally disposed segment 110 of the interlinking 32, and the opposite stub segments 100 and 102 of the wire hoop 30, as shown in FIG. 3. The tridirectional wires 34 and 36 comprise brace segments 164 and 166 that extend in the rearward to forward direction. The brace segments 164 and 166 are joined to the upper bends 158 and 160 and extend to forward bends 168 and 170. Retainer segments 172 and 174 extend outwardly from the forward bends 168 and 172 to outward bends 178 and 180. Stub segments 182 and 184 are joined to the outward bends 178 and 180 and extend to terminal ends 186 and 188. As a safeguard, the terminal ends 186 and 188 are covered with resilient caps 192 and 194 to cover metal burrs and the like.

The inverted-L wires 38 and 40 comprise vertical segments 200 and 202 that extend upwardly from lower terminal ends 204 and 206 to upper bends 208 and 210. The vertical segments 200 and 202 extend across and are welded to the centrally disposed segment 52 of the wire hoop 30, the centrally disposed segment 110 of the interlinking wire 32, and the opposite stub segments 100 and 102 of the wire hoop 30, as shown by FIG. 3. The inverted-L wires 38 and 40 further comprise horizontal segments 214 and 216 that are joined to the upper bends 208 and 210 and extend to forward terminal ends 218 and 220. The horizontal segments 214 and 216 have bending portions 222 and 224 spaced just rearwardly of the terminal ends 218 and 220, thereby providing upwardly turned sloping sections 226 and 228. As a safeguard, the forward terminal ends 218 and 220 are covered with resilient caps 230 and 232 to cover metal burrs and the like.

For manufacturing simplicity and efficiency, the centrally disposed segment 52 of the wire hoop 30, the centrally disposed segment 110 of the interlinking wire 32, and the opposite stub segments 100 and 102 of the wire hoop 30 are all coplanar with one another. Therefore, all the welded joints which rigidly fix the ski equipment support rack 10 together are likewise all coplanar with each other, because each welded joint involves one or another of the coplanar segments 52, 100, 102 or 110. More specifically, as shown by FIG. 3, the ski equipment support rack 10 is held together by twelve welded joints. The twelve welded joints are all coplanar, they are all easily accessible from the rear of the rack 10, and they are all on a rather localized area of the rear of the rack 10. These design and weld features contribute to the manufacturing efficiency and simplicity of the ski equipment support rack 10.

Figure 2:
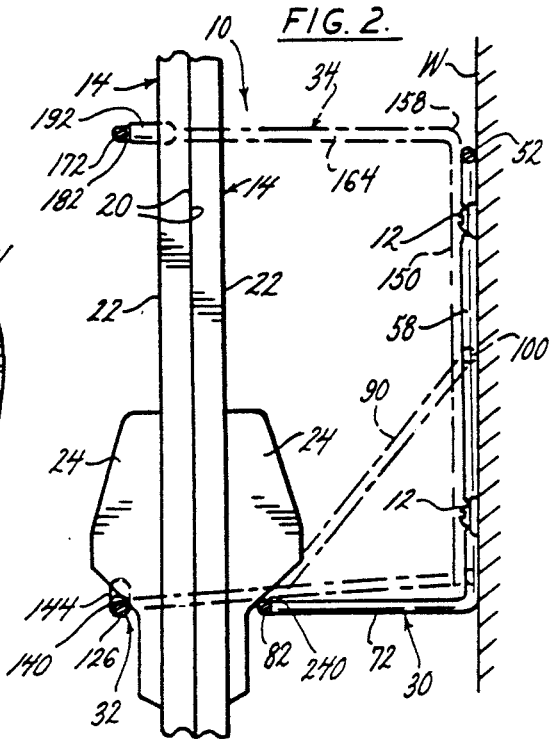
FIG. 2 is an enlarged section view taken along the line 2—2 of FIG. 1.

For supporting skis such as skis 14, the support segments 82 and 84 of the wire hoop 30 cooperate with the forwardly spaced support segments 126 and 128 of the interlinking wire 32 as shown by FIG. 2. More specifically, the left and right support segments 82 and 84 cooperate with the forwardly spaced, left and right support segments 126 and 128 to define left and right slots respectively. Access to those slots is provided adjacent to the left and right terminal ends 130 and 132 respectively of the interlinking wire 32. The slots permit the removable passage therethrough of two skis 14 mutually engaging one another's bottom surfaces 20 so that their bindings 24 extend oppositely. The support segments 82 and 84 of the wire hoop 30 and 126 and 128 of the interlinking wire 32 conjointly provide upper surfaces upon which the bindings 24 of the skis 14 can be removably supported (see FIG. 2).

For gaining strength without resort to large gauge wire, the brace segments 116 and 118 of the interlinking wire 32 cross over and engage the support segments 82 and 84 of the wire hoop 30 at contact points 240 and 242. The contact points 240 and 242 are located adjacent the inner forward bends 86 and 88, hence adjacent the inclined brace segments 90 and 92.

For mounting purposes, the ski equipment support rack 10 has four holes 254 for receiving screw fasteners 12 therethrough. Those holes are more particularly disposed on the vertical segments 58 and 60 of the planar back portion 46 as shown.

To support a pair of skis on this rack 10, the skis are oriented with their bottom surfaces 20 in mutual contact. Thereafter, it is easy to pass the skis 14 laterally inward from either the left or right side. As shown in FIG. 2, the primary support for the skis is by engagement of the support segments 82 and 126 (or 84 and 128) beneath the ski bindings 24. In this manner, the skis are supported away from the wall W. Although not likely to happen, such rotation of the skis 14 about the support segments 126 and 128 that would swing the upper portions of the skis forward is restricted by the retainer segments 172 and 174 of the tridirectional wires 34 and 36.

For removably supporting the ski poles 16, the tridirectional wires 34 and 36 cooperate with the inverted-L wires 38 and 40, as shown in FIG. 1. More specifically, the brace segments 164 and 166 of the tridirectional wires 34 and 36 are laterally spaced from the horizontal segments 214 and 216 of the inverted-L wires 38 and 40, defining a series of slots that extend horizontally in the rearward to forward direction. Access to these slots is provided by gaps adjacent to the forward terminal ends 218 and 220 of the inverted-L wires 38 and 40. Thus the brace segments 164 and 166 of the tridirectional wires 34 and 36 cooperate with the horizontal segments 214 and 216 of the inverted-L wires 38 and 40 to provide upper surfaces upon which the annular bottom surfaces 28 of the hand-grips 26 can be removably supported.

While the present invention has been described by reference to a specific embodiment, it should be understood that modifications and variations of the invention may be constructed without departing from the scope of the invention defined in the following claims.

What is claimed is:

1. A ski equipment support rack for attaching to a wall, comprising:

first means for removably receiving two generally upright skis that have mutually adjacent bottom surfaces and for removably supporting the two skis such that a plane cutting between the adjacent bottom surfaces is spaced forwardly from the wall;

second means for engaging the skis to restrict the revolution thereof about the first means;

third means for attaching to the wall and for securely supporting the first and second means;

the first means includes a forward member and a rearward member that is horizontally spaced rearwardly from the forward member, the members defining a slot therebetween; and, both the forward and the rearward members are segments of rod elements.

2. The ski equipment support rack of claim 1 wherein:

both the forward and the rearward members have proximal ends that are securely supported by the third means, distal ends that are laterally spaced from the proximal ends, and central portions that extend laterally between the proximal and distal ends for removably supporting the bindings of the removably received skis.

3. The ski equipment support rack of claim 2 wherein:

the distal ends of the forward and rearward members respectively define adjacent thereto an access to the slot.

4. A bent wire frame for supporting ski equipment, comprising:

a back portion for attaching to a wall;

a first member anchored to the back portion and comprising a first support segment spaced forwardly from the back portion; and a second member anchored to the back portion and comprising a second support segment that is disposed relative to the first support segment to define therebetween an open-ended slot; the slot extending laterally relative to the back portion;

the two support segments cooperatively providing removable support for the oppositely extending bindings of two generally upright skis that have mutually adjacent bottom sides.

5. The bent wire frame of claim 4 further comprising:

a third member anchored to the back portion and extending partly forwardly to a third support segment for engaging the removably supported skis to restrict revolution thereof about the first and second support segments.

6. The bent wire frame of claim 5 further comprising:

a fourth member anchored to the back portion and projecting partly forwardly to cooperate with the third member and so provide upper surfaces upon which ski pole flanges can be removably supported.

7. The bent wire frame of claim 6 wherein:

the third member includes a forwardly projecting segment, and the fourth member includes a forwardly projecting segment disposed relative to the other forwardly projecting segment to define an open-ended slot.

8. The bent wire frame of claim 4 wherein:

all the wires of the back portion, the first member, and the second member are metal, and all the wires are interconnected together by means of welded joints.

9. The bent wire of claim 6 wherein:

the second member projects past the first support segment in the rearward to forward direction at a crossing point; and means for interengaging the second member with the first member so that the second member gains support therefrom.

10. The bent wire frame of claim 4 wherein:

the back portion is planar; and each one of the back portion, the first member, and the second member has a laterally opposite counterpart.

11. The bent wire frame of claim 4 wherein:

the laterally extending slot permits the removable passage therethrough of two generally upright skis that have mutually adjacent bottom sides.

12. A ski equipment support rack comprising:

a back portion for attaching to a wall;

a first bracing segment having a rearward section interconnected with the back portion and projecting forwardly to a forward section;

a first support segment supported by the forward section and extending in the lateral direction relative to the back portion between a proximal section and a distal section;

a second bracing segment having an interengaging section interengaged with the first support segment proximate the proximal section, and projecting forwardly to an engaging section;

a second support segment joined to the engaging section and extending laterally therefrom in the distal direction to an opposite section;

wherein the first and second support segments can removably support two skis that have mutually adjacent bottom surfaces by providing upper surfaces upon which the oppositely extending bindings of the skis can be removably supported; and further comprising restricting means supported by the back portion for restricting revolution of the removably supported skis about the first and second support segments.

13. The ski equipment support rack of claim 12 wherein:

the first and second support segments define a slot that can removably receive the two skis, with access to the slot provided between the distal and opposite sections.

14. The ski equipment support rack of claim 12 further comprising:

means supported by the back portion for removably supporting ski poles by the flange portions thereof.

15. A ski equipment support rack comprising:

a back portion for attaching to a wall;

a first bracing segment having a rearward section interconnected with the back portion and projecting forwardly to a forward section;

a first support segment supported by the forward section and extending in the lateral direction relative to the back portion between a proximal section and a distal section;

a second bracing segment having an interengaging section interengaged with the first support segment proximate the proximal section, and projecting forwardly to an engaging section;

a second support segment joined to the engaging section and extending laterally therefrom in the distal direction to an opposite section;

wherein the first and second support segments can removably support two skis that have mutually adjacent bottom surfaces by providing upper surfaces upon which the oppositely extending bindings of the skis can be removably supported;

wherein the back portion is planar; and each one of the first and second bracing segments and the first and second support segments has a laterally opposite counterpart.

16. The ski equipment support rack of claim 15 wherein:

the second support segment and the opposite counterpart thereof are part of a single elongated element; and the first support segment and the opposite counterpart thereof are part of another single elongated element.

17. The ski equipment support rack of claim 16 wherein:

each of the two single elongated elements is an element of metal wire; and the metal wire elements are interconnected by means of other metal wires intercommunicating therebetween and welded thereto.

18. The ski equipment support rack of claim 16 wherein:

the first support segment and the opposite counterpart thereof are partly shaped to have a first planar-U portion; and the second support segment and the opposite counterpart thereof are partly shaped to have a second planar-U portion;

the second planar-U portion being sized for interlinking with the first planar-U portion, the second support segment and the opposite counterpart thereof gaining support thereby.

* * * * *